US006938371B2

(12) United States Patent
Van Beek

(10) Patent No.: US 6,938,371 B2
(45) Date of Patent: Sep. 6, 2005

(54) TURNSTILE DEVICE

(75) Inventor: Marcel Van Beek, Uithoorn (NL)

(73) Assignee: Boon Edam B.V., Edam (NL)

( * ) Notice: Subject to any disclaimer, the term of this patent is extended or adjusted under 35 U.S.C. 154(b) by 0 days.

(21) Appl. No.: 10/699,451

(22) Filed: Oct. 31, 2003

(65) Prior Publication Data

US 2004/0211120 A1 Oct. 28, 2004

Related U.S. Application Data

(63) Continuation of application No. PCT/NL02/00276, filed on Apr. 25, 2002.

(30) Foreign Application Priority Data

May 1, 2001 (NL) ..... 1017969

(51) Int. Cl.[7] ..... E06B 11/08
(52) U.S. Cl. ..... 49/47; 49/49
(58) Field of Search ..... 49/42, 46, 47, 49/49

(56) References Cited

U.S. PATENT DOCUMENTS 614,077 A * 11/1898 Beatty ..... 49/46
985,544 A * 2/1911 Perey ..... 49/46
987,445 A * 3/1911 Driver ..... 49/46
1,617,918 A * 2/1927 McLoughlin ..... 49/47
D188,191 S * 6/1960 Stevens et al. ..... 49/46
5,390,444 A * 2/1995 Simonin et al. ..... 49/47
5,979,113 A 11/1999 Hering
6,044,586 A * 4/2000 Wotke ..... 49/47

FOREIGN PATENT DOCUMENTS

SU 001763629 A1 * 9/1992 ..... 49/47

* cited by examiner

*Primary Examiner*—Jerry Redman
(74) *Attorney, Agent, or Firm*—Peacock Myers P.C.; Jeffrey D. Myers; Vidal A. Oaxaca

(57) ABSTRACT

The invention relates to a turnstile suitable for the controlled admittance of persons to a building or to an otherwise enclosed or guarded area, comprising a body mounted on a rotatable and blockable axis, which body is provided with at least three arms extending from the body, the arms being oriented such that when rotation of the body is blocked, at least one of the arms is positioned to prevent passage, while the arms extend substantially horizontally or at an angle upwards from the body.

5 Claims, 1 Drawing Sheet

TURNSTILE DEVICE

CROSS-REFERENCE TO RELATED APPLICATIONS

This application is a continuation of International Patent Application Serial No. PCT/NL02/00276, entitled "Turnstile Device", filed on Apr. 25, 2002, and claiming priority to The Netherlands Patent Application Serial No. 1017969, filed on May 1, 2001, and the specifications and claims thereof are incorporated herein by reference.

STATEMENT REGARDING FEDERALLY SPONSORED RESEARCH OR DEVELOPMENT (Not Applicable)

INCORPORATION BY REFERENCE OF MATERIAL SUBMITTED ON A COMPACT DISK OR MICROFICHE APPENDIX (Not Applicable)

BACKGROUND OF THE INVENTION

1. Field of the Invention

The invention relates to a turnstile suitable for the controlled admittance of persons to a building or to an otherwise enclosed or guarded area, comprising a body mounted on a rotatable and blockable axis, which body is provided with at least three arms extending from the body, the arms being oriented such that when rotation of the body is blocked, at least one of the arms is positioned to prevent passage.

2. Description of Related Art

Such a turnstile device is generally known from practice and is used, for example, as admittance control unit at airports and railway stations. The latter application is used mainly abroad. Such turnstile devices can also be found as admission control units at places of public amusement such as zoological gardens, swimming pools, and the like.

One problem of the known turnstile device is that passing through this turnstile device while taking along hand luggage meets with difficulties. Passage is then impossible because the turnstile device does not allow sufficient room. The biggest problems arise when taking along a luggage trolley or a suit bag or laptop bag.

BRIEF SUMMARY OF THE INVENTION

It is the object of the invention to provide a turnstile device with which these problems do not exist, so that a passing person can carry luggage along with him, while the function of the admittance control is maintained.

To this end the turnstile device according to the invention is characterized in that the arms extend substantially horizontally or at an angle upwards from the body.

The appearance of the turnstile device according to the invention may briefly be characterized as the known turnstile device turned 180°. However, for an optimised function of the turnstile device according to the invention more is needed than merely rotating the known turnstile device 180°. This will be discussed below.

In a further aspect of the invention the turnstile device is characterized in that the number of predetermined blockable positions of the body is at least equal the number of arms provided on the body. In this way the admission controlling function can be carried out adequately.

In every blockable position of the body it is desirable for at least one of the arms to be set in a substantially horizontal position.

A further aspect of the invention is that in every blockable position of the body the non-horizontal arms extend at an angle upwards in a direction pointing away from the passage obstructed by the horizontally positioned arm. This configuration of the arms means that the turnstile device according to the invention can be passed without problems even while carrying luggage, while in addition adequately reducing the danger of the person who passes through coming into sharp contact with the non-horizontal arms.

As further protection for persons passing through it is preferred for the free ends of the arms to be rounded-off.

BRIEF DESCRIPTION OF THE SEVERAL VIEWS OF THE DRAWINGS

The invention will now be further elucidated with reference to the drawing, which in FIG. 1 shows a side view of the turnstile device according to the invention.

Identical parts in the figures are identified by the same reference numbers.

DETAILED DESCRIPTION OF THE INVENTION

Figure 3:
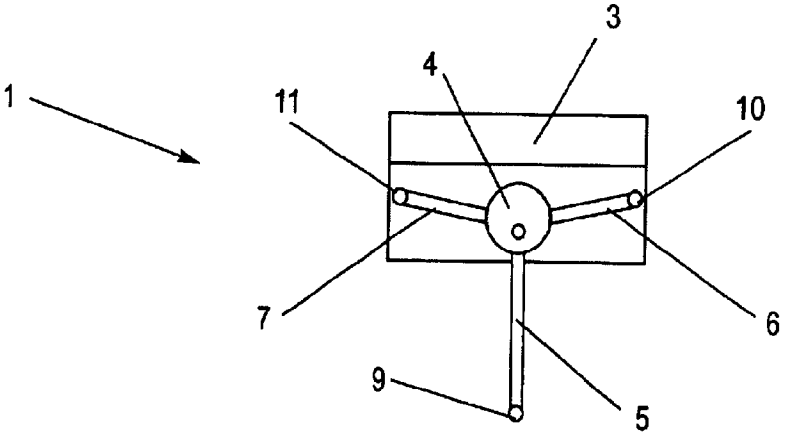
In FIG. 3 a shows a top view of the turnstile device according to the invention.
Figure 1:
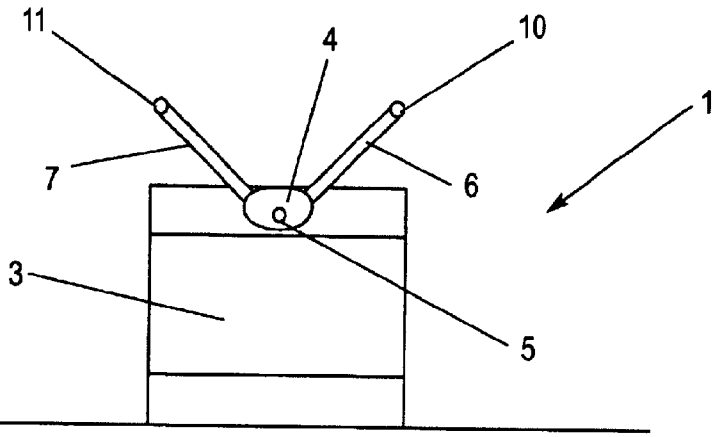

According to the invention, the turnstile device 1 serves for the controlled admittance of persons 2 to a building or otherwise enclosed or guarded area.

The turnstile device 1 is constructed on a base 3 in which a rotatable and blockable axis is mounted. This axis is not shown in the figures but is incorporated in the base 3 in a manner completely known to the person skilled in the art. On the said axis a body 4 is mounted, which accordingly rotates with the axis (not shown) and knows blocked positions determined by the axis.

As shown in the figures, the body 4 is provided with at least three arms 5,6,7 extending from the body 4. These are mounted on the body 4 in such a manner that when the body 4 is being turned to a predetermined blocking position, at least one arm, in the case illustrated arm 5, assumes a position that blocks the passage.

The figures clearly show that the arms 5,6,7 extend from the body 4 substantially horizontally, arm 5, or at an angle upwards, arms 6 and 7.

Figure 2:
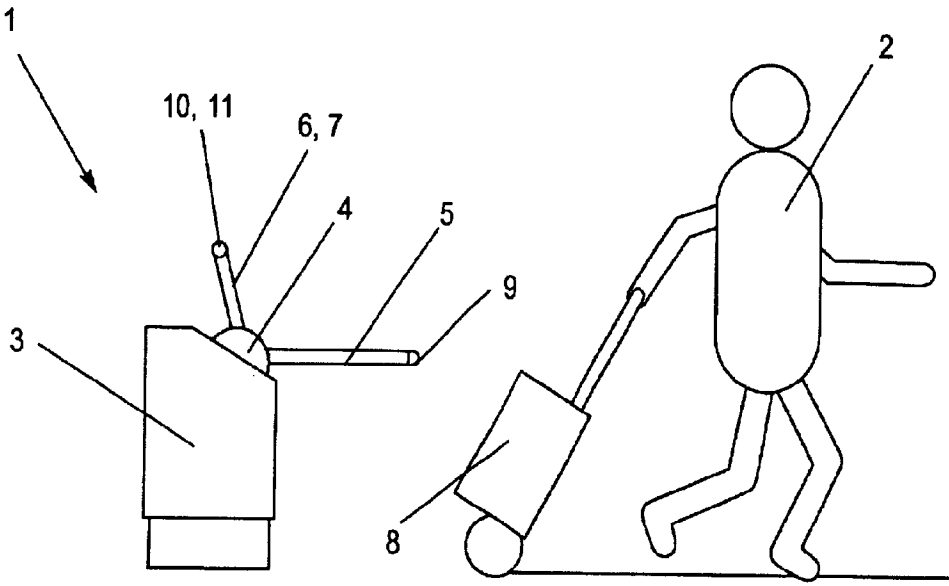
in FIG. 2 shows a front view of the turnstile device according to the invention.

The predetermined blocked positions that the body 4 is able to assume must at least coincide with the number of arms provided on the body 4. In the case illustrated therefore, the body 4 must have at least three blocking positions, each separate blocking position corresponding with a substantially horizontal position of one of the arms. In the case illustrated this is arm 5. The other arms of the turnstile device 1 are at that moment in a position extending upwards at an angles in a direction pointing away from the passage blocked by the horizontally positioned arm 5. This can be clearly seen in FIGS. 2 and 3. A person 2 with a luggage trolley or another item of luggage is thus able to pass the turnstile device 1 without any problems.

The figures further show that the arms 5,6,7 have a rounded-off free end 9,10,11, for the protection of the passing person.

What is claimed is:

1. A turnstile suitable for a controlled admittance of a person to an area, comprising:

a body mounted on a rotatable axis extending at an acute angle with respect to a horizontal, the rotation of said axis being stoppable; and at least three arms pivotally extending from said body, said arms being oriented such that when rotation of said body around said axis is stopped, a longitudinal axis of at least one of said arms is oriented substantially horizontally and positioned to prevent passage of the person past said at least one of said arms into said area, and said other arms extend at an angle upwardly away from said body and above said at least one arm oriented substantially horizontally.

2. A turnstile according to claim 1, wherein a number of predetermined stoppable positions of said body is at least equal to a number of arms extending from said body.

3. A turnstile according to claim 2, wherein in every said blockable position of said body at least one of said arms is set in a substantially horizontal position to obstruct passage by the person into the area.

4. A turnstile according to claim 3, wherein in every said blockable position of said body, other said arms extend at an angle upwards from said body in a direction pointing away from a passage obstructed by said substantially horizontally positioned arm.

5. A turnstile according to claim 1, wherein each of said arms comprises a free end comprising a convex shape.

* * * * *